United States Patent [19]

Kwon

[11] 4,176,807

[45] Dec. 4, 1979

[54] KITE-FLYING CONTROL REEL

[76] Inventor: Nathan J. Kwon, 1625 Greenleaf Ave., Des Plaines, Ill. 60018

[21] Appl. No.: 936,327

[22] Filed: Aug. 24, 1978

[51] Int. Cl.[2] ..... B65H 75/40

[52] U.S. Cl. ..... 242/96; 244/155 A

[58] Field of Search ..... 242/96, 84.1 J, 99, 242/84.2 J, 100; 244/155 A

[56] References Cited

U.S. PATENT DOCUMENTS

| | | | |
|---|---|---|---|
| 2,587,432 | 2/1952 | Ballah | 242/96 |
| 3,652,027 | 3/1972 | Wong | 242/99 |
| 4,101,090 | 7/1978 | Waif | 244/155 A |

*Primary Examiner*—Edward J. McCarthy

*Attorney, Agent, or Firm*—Patrick T. King; David L. Garrison

[57] ABSTRACT

A kite-flying control reel having a spool rotatably mounted on an axle. A three part handle has the axle affixed at right angles to a first portion. Second and third handle portions extend from the first portion in directions parallel to and away from the axle. A lever-operated, spring-loaded ratchet and pawl assembly locks the spool to the handle. A releasable clutch mechanism couples a spool crank arm to the spool.

19 Claims, 10 Drawing Figures

Fig. 1
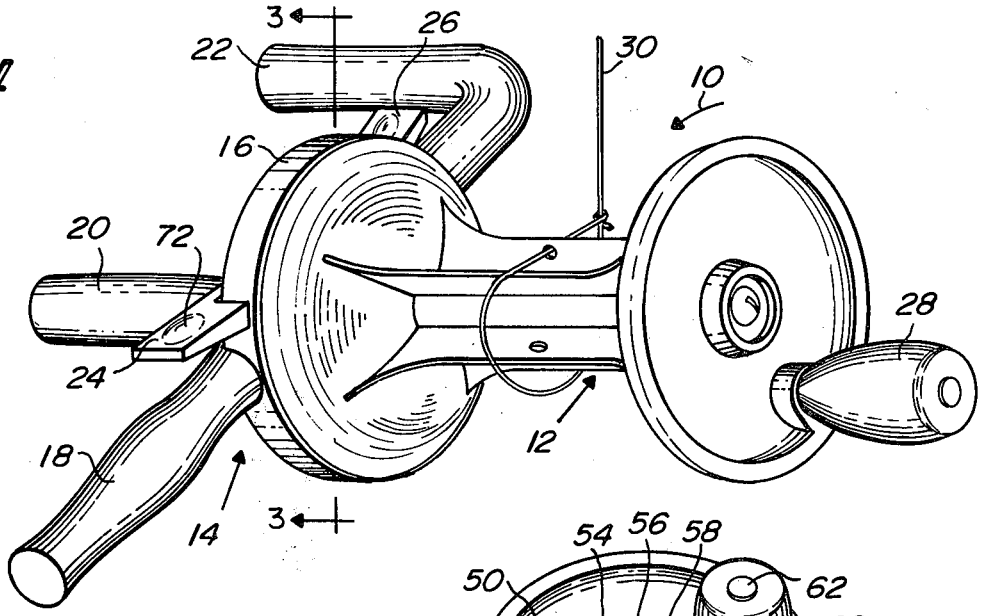
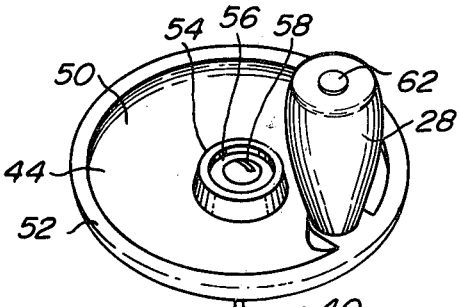
Fig. 3
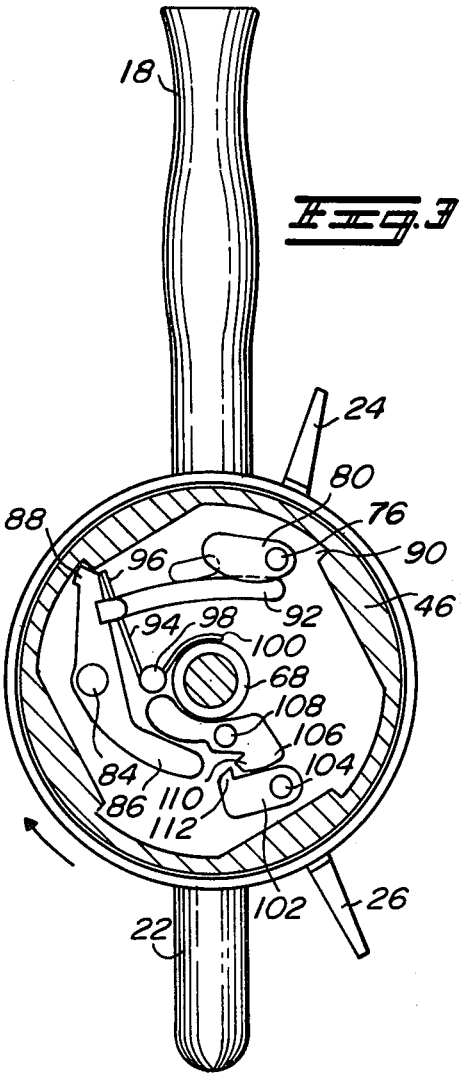
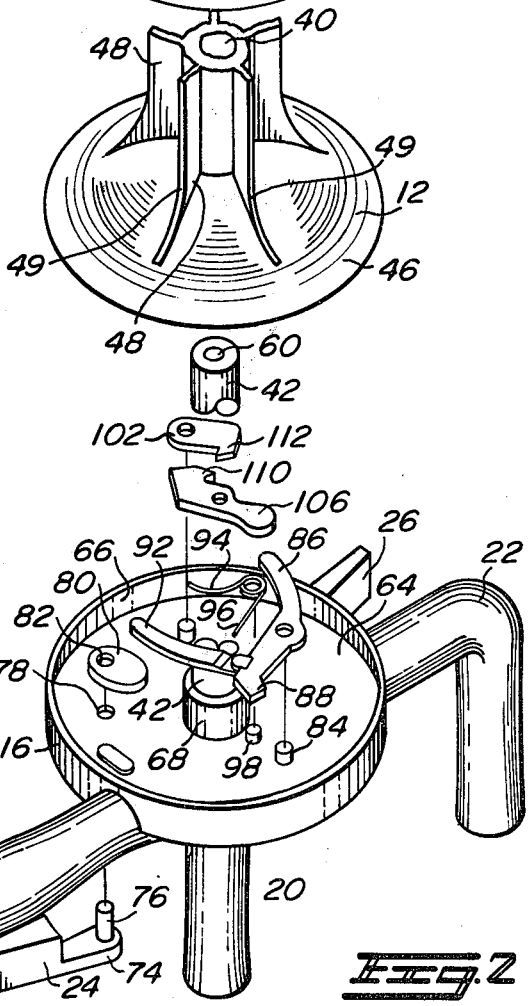
Fig. 2

Fig. 4
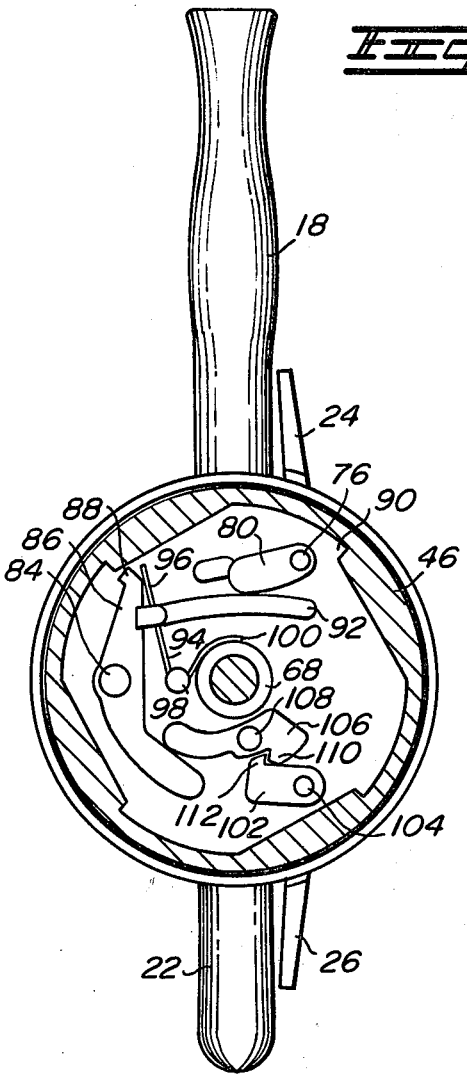
Fig. 8
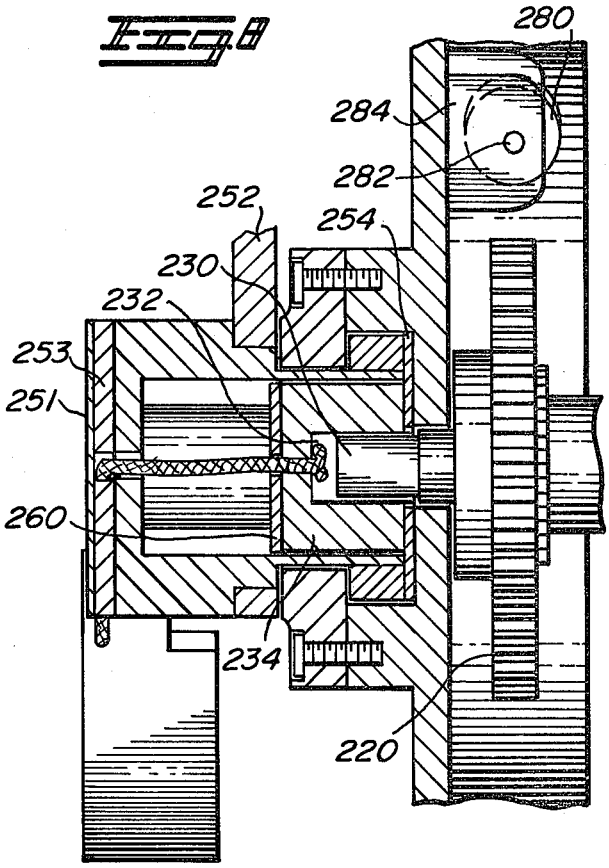
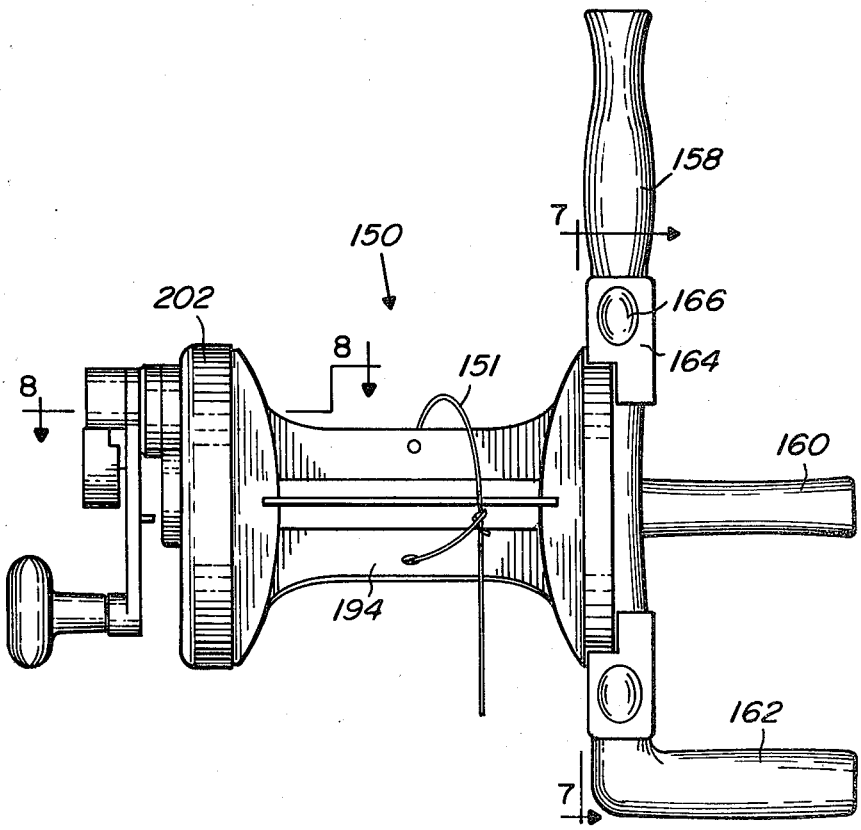
Fig. 5

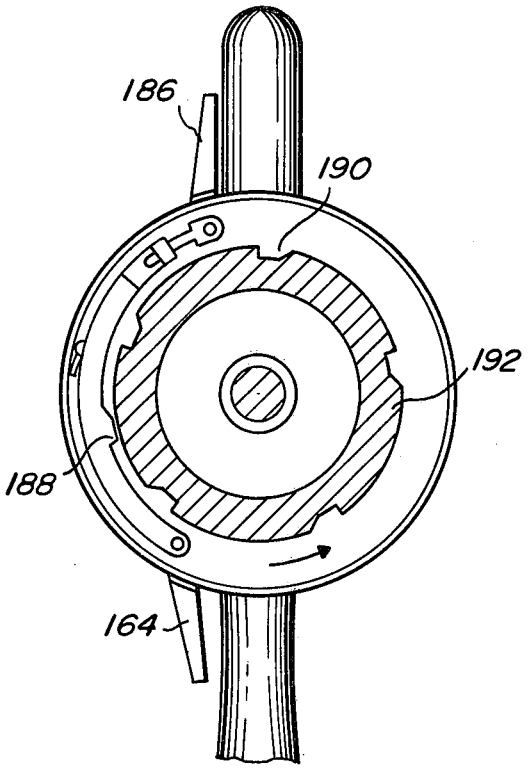
Fig. 7
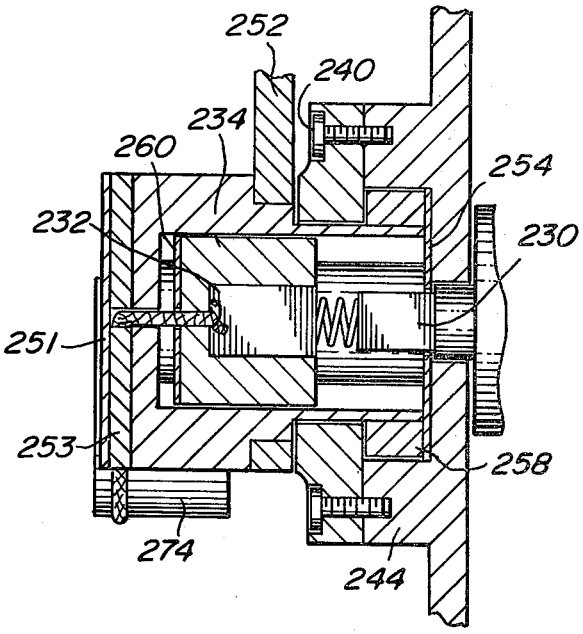
Fig. 9
Fig. 10
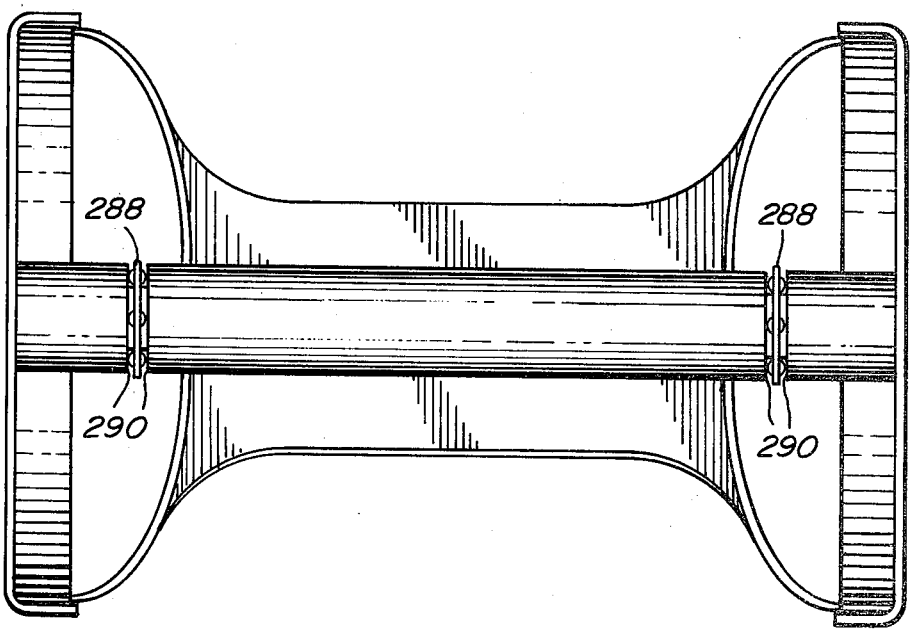

KITE-FLYING CONTROL REEL

BACKGROUND OF THE INVENTION

This invention relates to a reel assembly for winding cord. Specifically, this invention relates to a reel assembly for controlling and maneuvering a kite.

In the prior art a reel assembly for use in kite flying generally includes a single handle for supporting the reel assembly. For example, U.S. Pat. No. 2,434,479 granted to R. R. Allen on Feb. 15, 1946, shows a reel assembly with a single handle extending from and coaxial with the axis of a spool. U.S. Pat. No. 3,731,887 granted to C. E. Wheeler on May 8, 1973, discloses a reel having a single handle perpendicularly alligned with the axis of a spool. When using the above-mentioned types of reels for kite flying, the user is required to hold the reel in one particular position. No means is provided for comfortably holding these reels in a variety of positions. In addition, the prior art reels are not particularly well adapted for facilitating maneuvering and control of a kite. This is particularly important when using a reel during conditions of high velocity winds where a great deal of effort is often required by an operator to maneuver and to maintain control of a kite so that an operator may quickly become fatigued when using a prior art reel.

It is often advantageous when flying a kite to have a clutch arrangement for the kite-reel spool so that either the spool can be freely rotated to release or rewind cord or the spool can be locked to aid in controlling the kite. U.S. Pat. No. 3,652,027 granted to Y. C. Wong on Mar. 28, 1972, discloses a thumb-operated spool ratchet clutch arrangement located intermediate a handle portion and an axle extension of a kite reel. It would be advantageous to have a kite-flying control reel which permits the spool clutch to be operated in a variety of operator positions.

Prior art kite-flying control reels generally have spool-winding means which include a crank handle attached to the cord spool; gearing arrangements to improve winding speed are generally not provided, particularly releasably engageable gearing means.

SUMMARY OF THE INVENTION

It is an object of this invention to provide a multi-handled reel assembly for kite flying adaptable to being held by an operator in a variety of positions.

It is another object of this invention to provide a kite-flying reel which permits an operator to more effectively control and maneuver a kite as well as to reduce operator fatigue.

It is another object of the invention to provide a multi-handled kite-control reel assembly which permits easy operator control of a spool clutch.

It is another object of the invention to provide a gearing arrangement to assist in winding cord on a kite-flying control reel.

Briefly, the invention provides a kite-flying control reel having a first elongated handle with a spool rotatably mounted on an axle affixed at right angles to the first elongated handle. A second handle is provided affixed to the first handle and extends parallel and away from the axle. According to another aspect of the invention, a clutch assembly for releasably engaging the spool with a portion of the first handle is provided. According to another aspect of the invention, a gear drive means is provided for rotating the spool about the axis.

BRIEF DESCRIPTION OF THE DRAWINGS

For a more complete understanding of the invention, reference is made to the drawings in which:

FIG. 1 is a perspective view of one embodiment of a kite-flying control reel assembly according to the invention;

FIG. 2 is an exploded perspective of the reel assembly of FIG. 1;

FIG. 3 is a partial cross-sectional view of a portion of the reel assembly of FIG. 1 taken along sectional line 3—3 with a ratchet clutch mechanism shown in an engaged position;

FIG. 4 is a partial cross-sectional view of a portion of the reel assembly of FIG. 1 taken along sectional line 3—3 with the ratchet clutch mechanism shown in a disengaged position;

FIG. 5 is a plan view of another embodiment of a kite-flying control reel assembly according to the invention;

FIG. 7 is a partial cross-sectional view of a portion of the reel assembly of FIG. 5 taken in the direction of sectional line 7—7;

FIG. 8 is a partial cross-sectional view along sectional line 8—8 of a portion of the reel assembly of FIG. 5 with a ratchet clutch mechanism shown in an engaged position;

FIG. 9 is a partial cross-sectional view of a portion of the reel assembly of FIG. 5 along the sectional line 8—8 with the ratchet clutch mechanism shown in a disengaged position; and FIG. 10 is a partial cross-sectional view of a reel assembly having alternative bearing means for a reel spool.

DETAILED DESCRIPTION OF THE PREFERRED EMBODIMENTS

Figure 6:
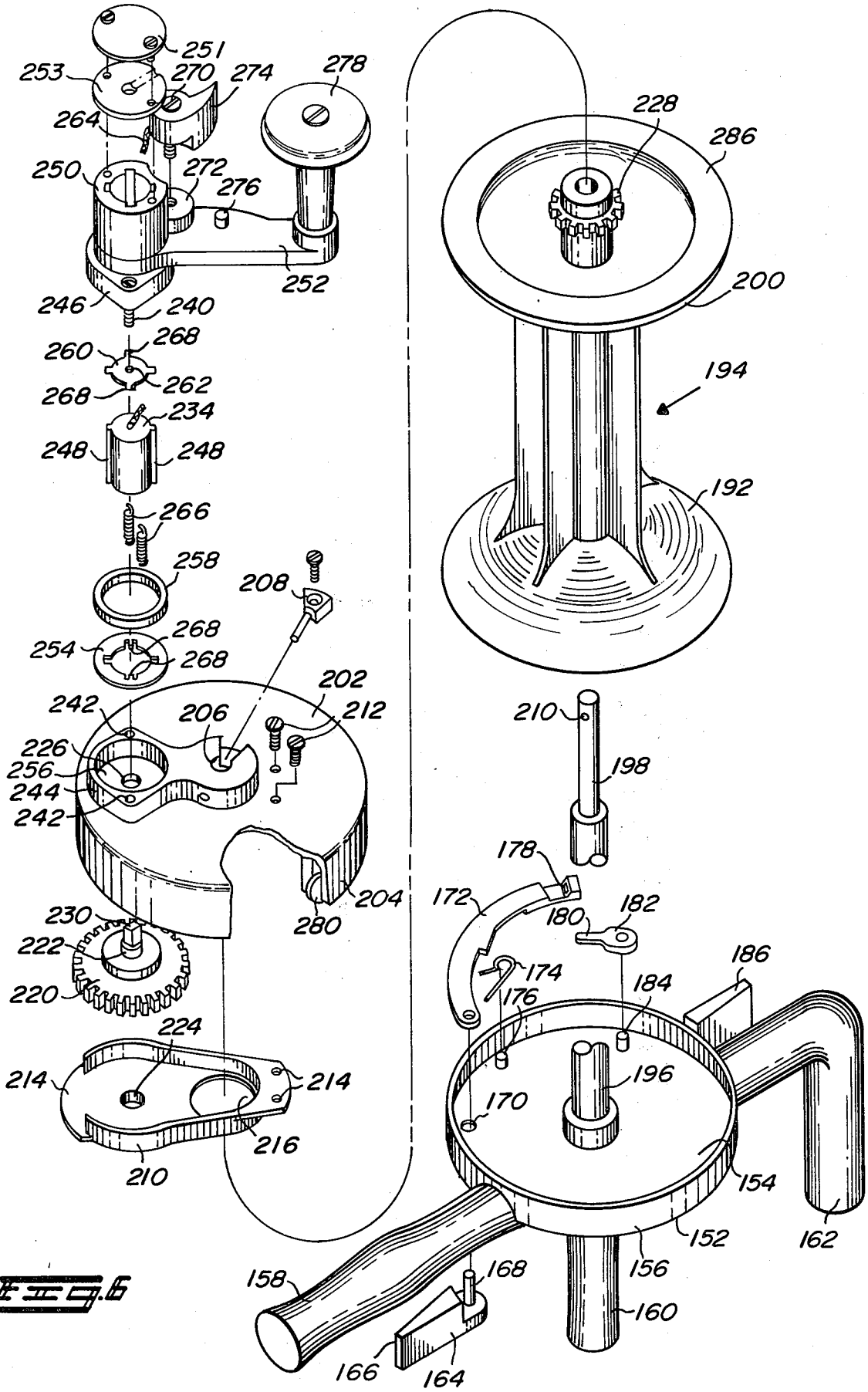
FIG. 6 is an exploded perspective view of the reel assembly of FIG. 5.

Referring to FIG. 1 of the drawings, one embodiment of a kite-flying reel assembly 10 is shown. A generally cylindrically shaped spool 12 having an axis is rotatably mounted to a frame 14. The frame 14 includes a base portion 16 having first, second, and third handle portions 18, 20, 22, respectively, attached to and extending therefrom. Clutch levers 24, 26 respectively extend from the base portion 16. A spool-winding knob 28 is provided on the spool 12 for an operator to grasp and wind cord 30 around the spool 12. The first handle 18 is positioned generally perpendicular to the axis of the spool 12. The first handle 18 is generally cylindrical in shape and has a contoured outer surface to facilitate grasping by an operator. The second handle 20 extends outwardly from and is coaxial with the axis of the spool 12. The third handle 22 extends generally parallel to the axis of the spool 12 but is offset therefrom and is attached to the far end of the first handle 18, as shown. The handles are formed, for example, from wood, plastic, and other suitable materials.

In operation, the reel assembly 10 is used by an operator in a variety of positions. For example, in one position, the third handle 22 rests against the body of an operator. The first handle 18 extends generally outwardly from the front of the operator's body and is grasped by the fingers of the operator's left hand. The operator's left forearm extends either above or beaneath the second handle 20 and provides support for the reel assembly 10. It is readily apparent that in this position the operator's body, left forearm, and left hand all provide solid support for the reel assembly. This support allows a kite attached to a string wound around the spool 12 to be comfortably and effectively controlled and maneuvered by the operator's left arm and hand. The clutch lever 24 is actuated by the fingers of the operator's left hand while the operator's right hand is free to turn the spool knob 28 or to control the spool and cord 30, as required.

In another position, the third handle 22 rests against the body of the operator with the first handle 18 extending outwardly away from the operator's body. The operator's left hand grasps the second handle 20 and the operator's right hand is free to rotate and control the spool or to grasp one of the handles, as required.

In another position, the first handle 18 extends away from the operator and the third handle 22 is grasped by the operator's left hand, again leaving the operator's right hand free to be used as required.

In another position, the second handle 20 is grasped by the operator's left hand with the third handle 22 located away from the operator's body.

In another position, the first handle 18 is grasped by the hand of the operator with the second and third handles 20, 22 located away from the operator's body. The clutch lever 24 is operated by the thumb of the operator's left hand.

In the operational positions as described above and in other positions available to a user, it is readily apparent that the clutch levers 24, 26 may be contacted and actuated by various portions of an operator's hand as required. Each of the various positions in which the kite-flying control reel is held permits an operator to use the handles forming the frame 14 to best advantage so as to more effectively control the forces applied to a kite being flown. For example, the operator's body may serve as a fulcrum point and the frame as a lever arm to increase the force applied to the kite string.

Referring now to FIG. 2 of the drawings, further details of components of the kite-flying control reel 10 embodiment are shown. The spool 12 is a generally cylindrically shaped body having an axis extending therethrough. The spool and the other reel components are formed, for example, from wood, plastic, metal, or other suitable materials. The spool 12 has an axial central bore 40 contained therein for receiving an axle 42 therein, the axle 42 rotatably supporting the spool 12. The spool 12 has a first end flange 44 at one end and a second end flange 46 at the other end thereof. A plurality of longitudinally extending ribs 48 (typically shown) are comprised of thin plates extending between the end flanges 44, 46 with the outermost ends 49 of the flanges 48 describing a concave curve for guiding cord towards the center of the spool. The ribs 48 effectively increase the diameter of the cord holding portion of the spool. The first end flange 44 has a generally concave outer face with a generally smooth rounded peripheral edge portion 52. Contained within a recess in a boss 54 centrally located in the first end flange 44 is a washer 56 through which passes a screw 58. The screw 58 is threaded into a bore 60 at the end of the axle 42 and rotatably fastens the spool to the axle 42. The knob 28, which has a generally rounded configuration to facilitate grasping by an operator's hand, is fastened to the first end flange 44 by a pin 62.

The base portion 16 has a circular plate portion 64 with an upstanding peripheral rim portion 66 formed thereon. The second end flange 46 of the spool 12 fits within the upstanding rim 66. Extending through and fixed within an apertured boss 68 formed in the center of the circular plate portion 64 is the axle 42. Coaxially extending in the opposite direction from the axle 42 is the second handle 20. As shown in FIG. 2 of the drawings, the first handle 18 extends across the underside of the base portion 16 with the third handle portion 22 extending from the far end of the first handle portion 18 generally parallel to the axis of the axle 42. The clutch lever 24 has a generally rectangular thumb, or finger, actuated pad portion 70 having a tapered configuration as shown and having depressed portions 72 formed in one surface thereof to facilitate finger or thumb operation. Extending away from the pad portion 70 of the lever 24 is a lever portion 74 having a pin 76 affixed to the end thereof. The pin extends through and rotates within an aperture 78 through the circular plate portion 64. To the free end of the pin 76 is affixed a cam member 80 having an aperture 82 therein for receiving the end of the pin 76. Pivotally attached to the circular plate portion 64 by means of a pin 84 as shown in FIGS. 2, 3 and 4 of the drawing, is a pivotable member 86 which has a tooth 88 extending therefrom for engaging ratchet slots 90 formed in the underside of the second end flange 46 shown in FIGS. 3 and 4 of the drawings. Affixed to and extending from the pivotable member 86 is an extension member 92. An edge of the cam member 80 bears against an edge of the extension member 92 so that when the clutch lever 24 is moved from the position shown in FIG. 3 to that shown in FIG. 4, the tooth 88 is caused to disengage from one of the ratchet slots 90 permitting the spool to freely rotate about the axle 42. When the tooth 88 engages one of the ratchet slots 90, rotation of the spool 12 is permitted in the clockwise direction of FIG. 3 with a drag being exerted on the spool 12 by a spring 94. FIG. 1 shows the cord 30 extending from the bottom of the spool 12 and when the clutch lever 24 is not depressed, cord 30 may only be wound onto the spool 12 and may not be released. As shown in FIG. 3, when the clutch lever 24 is not depressed, the spring 94 having a first end 96 engages the pivotable member 86 near the tooth 88 and biases the tooth 88 into one of the ratchet slots 90. The spring 94 is pivotably attached to the circular plate portion 64 by means of a pin 98 with the second end of the spring 100 bearing against the exterior of the apertured boss 68.

The other clutch lever 26 has a second cam member 102 similarly mounted to a pin 104 for pivotable rotation. An intermediate lever 106 pivotable about a pin 108 has a tooth 110 at one end thereof which is engaged by a tooth 112 on the second cam member 102. The other end of the intermediate lever 106 has an edge which pushes against an edge of the pivotable member 86. As shown in FIG. 4 of the drawing, actuating the lever 26 causes the tooth 88 on the end of the pivotable member 86 to be disengaged from one of the ratchet slots 90.

Thus, either the lever 24 or the lever 26 is actuated to disengage the tooth 88 from one of the ratchet slots 90 so that the spool may freely rotate in either direction about the axle 42.

Referring to FIG. 5 of the drawing, another embodiment of a kite reel assembly 150 according to the invention is shown. The same kite reel assembly is also shown in an exploded perspective view in FIG. 6 of the drawings. A base portion 152 includes a circular plate portion 154 having an upstanding peripheral rim portion 156. Attached to the underside of the base portion 152 is a first handle 158, a second handle 160, and a third handle 162, all of which are constructed and function similar to the first, second, and third handles of the previously described embodiment. A first ratchet clutch lever 164 having a depression 166 contained in one surface of a wedge-shaped finger, or thumb, actuated portion has a pin 168 contained therein which extends through an aperture 170 in the circular plate portion 154 of the base portion 152. Affixed to the end of the pin 168 is a lever 172 which is biased by a spring 174 supported by a pin 176, one end of the spring engaging the inside of the upstanding peripheral rim portion 156 of the base 152 and the other end of the spring engaging an undercut portion of the lever 172. The end of the lever 172 opposite the portion having the pin 168 affixed thereto has a socket portion 178 contained therein which receives a projecting portion 180 of a lever 182 affixed to a pivotable pin 184 which projects through an aperture in the circular plate portion 154 and which is connected to a second ratchet clutch lever 186. When either of the levers 164, 186 are pushed toward the first handle 158 as shown in FIG. 7 of the drawings, a tooth 188 on the lever 172 is disengaged from one of the plurality of ratchet slots 190 formed in the exterior side of a flange 192 which is part of a spool 194.

When the tooth 188 engages a ratchet slot 190, the spool may rotate only in a counterclockwise direction as viewed in FIG. 7, the cord 151 extending out from the top part of the spool 194 as shown in FIG. 5 of the drawing may only be wound onto the spool 12 and may not be released.

An axle 196 extends from the circular plate portion coaxial with the second handle 160. Rotatably mounted on the axle 196 is the spool 194 similar in construction to the spool of the previously described embodiment of this invention. A portion 198 of the axle 196 having a reduced diameter extends through the end of the spool 194 adjacent to a second spool end flange 200. An end cap 202 having a downwardly extending peripheral flange portion 204 has an aperture 206 contained therein for receiving the reduced portion 198 of the axle 196. The end cap 202 is fastened to the axle 196 by means of a pin 208 extending through an aperture 210 in the axle 196 and fastened to the end cap 202 by a screw. A gear retaining bracket 210 is fastened to the inside of the end cap 202 by means of screws 212 being threaded into aperture 214 at one end of the bracket 210, the other end of the bracket 210 having a projecting tab 214 for engaging a slot (not shown) in the end cap 202. An axle clearance hole 216 is provided in the gear retaining bracket 210. A gear 220 has a shaft 222 extending through the center thereof, with the lower end of the shaft 222 extending through an aperture 224 in the bracket 210 and the other end of the shaft 222 extending through an aperture 226 in the end cap 202, the gear 220 thereby being rotatably mounted. The gear 220 engages a geared portion 228 located at the end of the spool 194.

Referring to FIGS. 6, 8, and 9 of the drawings, shaft 222 has a squared end 230 which engages a corresponding square socket 232 formed in a slideable coupling member 234. The slideable coupling member 234 has radially projecting guide ribs 248 at the opposite sides thereof extending longitudinally which engage corresponding slots in a central bore in a coupling guide cap 250. The coupling guide cap 250 has a generally cylindrical exterior surface. The bore guides the slideable coupling member 234 with the slots containing the guide ribs 248. The crank arm 252 has an aperture in one end thereof which allows the coupling guide cap 250 to fit within the aperture. The crank arm 252 is fastened to the coupling guide cap 250 with screws (not shown). A circular bottom plate 254 fits within a bore 256 in a raised boss portion 244 of the end cap 202. The bottom plate 254 is attached to the lower surface of a spacer ring 258 which in turn fits around and is glued to the lower part of the coupling guide cap 250. The spacer ring 258 then is held within the bore 256. The coupling guide cap 250 and crank arm 252 assembly are fastened to the end cap 202 by means of screws 240 being threaded into apertures 242 in a raised boss portion 244 of the end cap 202. The screws 240 extend through holes in a mounting bracket 246 which have a central aperture for passing the lower part of the coupling cap 250 therethrough. The crank arm and guide cap rotate within the mounting bracket 246. A top plate 260 having an aperture 262 contained therein for allowing passage of a coupling control cord 264 is fastened to the top of the slideable coupling member 234. The hooked ends of springs 266 are fastened to tabs 268 respectively on the bottom plate 254 and the top plate 260. The springs 266 pass through clearance slots in the guide cap 250 adjacent to the central bore. When assembled, the springs 266 bias the slideable coupling member 234 such that the socket 232 formed therein engages the squared end 230 of the shaft 222, so that when the crank arm 252 is rotated, the gear 220 and the spool 194 are rotated. Rotatably mounted by a screw 270 to a boss 272 on the crank arm 252 is a clutch lever 274 to which is attached the coupling control cord 254. A channeled plate 253 has a central hole passing therethrough and a channel radially extending from the central hole. An end cover plate 251 is positioned over the channeled plate 253 with the coupling control cord 264 passing through the central hole and channel in the channeled plate 253. Both the channeled plate 253 and the end cover plate 251 are fastened to the coupling guide cap 250 with screws as shown. In operation, when the clutch lever 274 is rotated, the coupling control cord 264 is drawn out of the coupling guide cap 250 causing the socket 232 in the slideable member 234 to disengage the squared end of the shaft 222. The clutch lever 274 is retained in the disengaged position by means of a pin 276 which is ball-detented in either one of two positions. Affixed to the end of the crank arm 252 is a knob 278 to facilitate rotation of the crank arm.

FIGS. 8 and 9 show the slideable coupling member 234, respectively, in the engaged and the disengaged positions with the squared end 230 of the gear 220.

FIG. 6 in the cutaway part of the end cap 202 shows a portion of a spool roller wheel 280, also shown in FIG. 8 rotatably mounted on a pin 282 which is affixed to a boss portion 284 of the end cap 202. A plurality of the roller wheels 280 (not all shown) act as bearings for the spool 194, with the roller wheels 280 bearing on the surface 286 of the second end flange 200.

FIG. 10 shows an alternative method of supporting a spool utilizing ball bearing assemblies 288 which have an axle passing therethrough. The surfaces 290 on the spool and the reel end cap and base portions serve as the bearing surfaces. The ball bearing assembly includes a plurality of balls held in position by a retainer plate.

While particular embodiments of kite-flying control reels according to the invention have been shown and described, it should be understood that the invention is not limited thereto since many modifications may be made. It is therefore contemplated to cover by the present application any and all such modifications that fall within the true spirit and scope of the basic underlying principles disclosed and claimed herein.

What is claimed is:

1. A kite-flying control reel comprising:
a first elongated handle;
an axle affixed at a right angle to the first elongated handle;
a second handle affixed to the first elongated handle at a right angle thereto and extending parallel to and away from the axle; and
a spool rotatably mounted on the axle.

2. The reel of claim 1 including a third handle affixed to the first elongated handle at a right angle thereto and extending parallel to and away from the axle, the third handle spaced apart from the second handle.

3. The reel of claim 1 wherein the first handle is a cylindrical rod having a variable cross-sectional area.

4. The reel of claim 1 wherein the spool is a cylinder having an axial bore extending therethrough for receiving the axle and wherein the spool has an end flange at each end thereof.

5. The reel of claim 4 including a plurality of rollers engageable with an end flange of the spool to permit rotation of the spool with respect to the axle.

6. The reel of claim 1 including a ball bearing assembly for permitting rotation of the spool about the axle.

7. The reel of claim 1 wherein the spool has a plurality of spaced-apart longitudinal ribs extending radially therefrom.

8. The reel of claim 1 including a clutch assembly for releasably engaging the spool with a portion of the first handle.

9. The reel of claim 8 wherein the clutch assembly includes a spring-loaded ratchet and pawl assembly and an operating lever for controlling the engagement thereof.

10. The reel of claim 9 including a base portion affixed to the first elongated handle, the base portion having pivotably affixed thereto a pivotal lever actuated by the operating lever and having a tooth, at least one ratchet-slot portion in a flanged end of the spool with the ratchet-slot portion engageable by the tooth.

11. The reel of claim 1 including gear drive means for rotating the spool about the axle.

12. The reel of claim 11 wherein the gear drive means comprises:
an end housing supported at the end of the axle remote from the first handle;
a first gear affixed to an end of the spool;
a second gear journaled on a shaft in the end housing and engaged with the first gear; and
a crank arm coupled to the second gear and rotatably supported on the end housing.

13. The reel of claim 11 including a releasable clutch mechanism for decoupling the crank arm from the second gear.

14. The reel of claim 13 including:
a slideable coupling between the second gear shaft and the crank arm; and
a coupling actuator means for moving the slideable coupling.

15. The reel of claim 14 wherein the coupling actuator means includes an actuator lever journaled on the crank arm and wherein a control cord is connected between the actuator lever and the coupling actuator means so that in a first position of the actuator lever the slideable coupling couples the second gear shaft to the crank arm and in a second position of the actuator lever the slideable coupling decouples the second gear shaft from the crank arm.

16. The reel of claim 15 including means for biasing the slideable coupling into engagement with the second gear shaft.

17. The reel of claim 16 including means for locking the actuator lever in the second position.

18. The reel of claim 16 wherein the second gear shaft has a non-round portion extending through the end housing and wherein the slideable coupling has a complementary non-round portion and including guide means within the crank arm for guiding the slideable coupling.

19. A kite-flying control reel comprising:
a base with an upstanding wall at the periphery thereof;
an axle having an axis perpendicularly extending outwardly from the base;
a spool having an axial bore formed therein for receiving the axle and having a radially extending flange at each end thereof, one of the flanges being contained within the upstanding wall of the base, the spool being rotatably mounted on the axle;
means for rotating the spool about the axle;
a first handle extending from the base generally perpendicularly to the axis of the axle;
a second handle extending from the base along the axis of the axle;
a third handle extending from the first handle in a direction parallel to the axis of the axle and located offset from the axle;
a releasable ratchet means for coupling the spool to the base.

* * * * *